United States Patent [19]

Bouchard et al.

[11] 4,421,493

[45] Dec. 20, 1983

[54] METHOD OF MAKING PHOTOFLASH LAMP

[75] Inventors: Andre C. Bouchard, Peabody; Robert F. Craig, Danvers, both of Mass.

[73] Assignee: GTE Products Corporation, Stamford, Conn.

[21] Appl. No.: 353,302

[22] Filed: Mar. 1, 1982

[51] Int. Cl.[3] ..... F21K 5/02

[52] U.S. Cl. ..... 445/28; 417/362

[58] Field of Search ..... 445/28; 417/362, 365

[56] References Cited

U.S. PATENT DOCUMENTS

| | | | |
|---|---|---|---|
| 3,220,224 | 11/1965 | Baird | 431/362 |
| 3,228,216 | 1/1966 | Desaulniers et al. | 431/362 |
| 3,303,674 | 2/1967 | Anderson | 431/362 |
| 3,304,144 | 2/1967 | Anderson | 445/28 |
| 3,630,650 | 12/1971 | Kaufmann et al. | 431/362 |
| 4,229,161 | 10/1980 | Bouchard et al. | 431/362 |
| 4,348,173 | 9/1982 | English et al. | 431/362 |

*Primary Examiner*—Kenneth J. Ramsey

*Attorney, Agent, or Firm*—Lawrence R. Fraley

[57] ABSTRACT

A method of making a photoflash lamp wherein an elongated piece of glass tubing is sealed at a first end thereof to secure a pair of lead-in wires therein. Thereafter, a first quantity of primer material is positioned within the glass tubing through a second, open end thereof and deposited on an internal bottom surface of the tubing. A quantity of combustible material (e.g., zirconium) is then air blown within the tubing member, and thereafter a thin member (mica disk) is inserted through the open end, said disk having a second quantity of primer material thereon. The tubing member is then restricted, a combustion-supporting atmosphere (e.g., oxygen) introduced therein, and the second open end of the tubing member is sealed (tipped) to define the finished envelope.

7 Claims, 8 Drawing Figures

FIG. 3
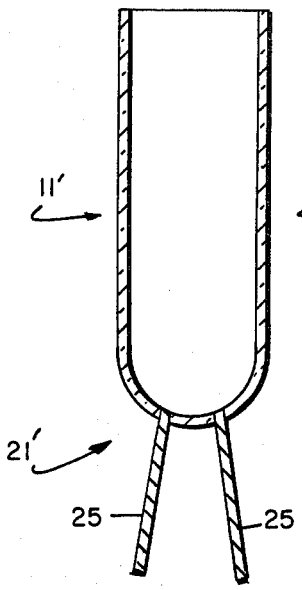
FIG. 4
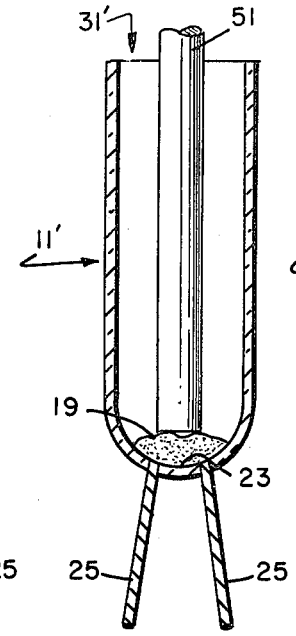
FIG. 5
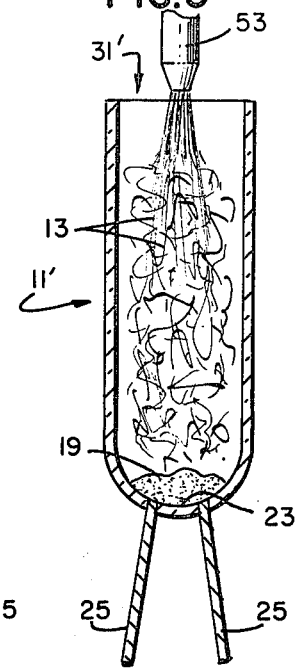
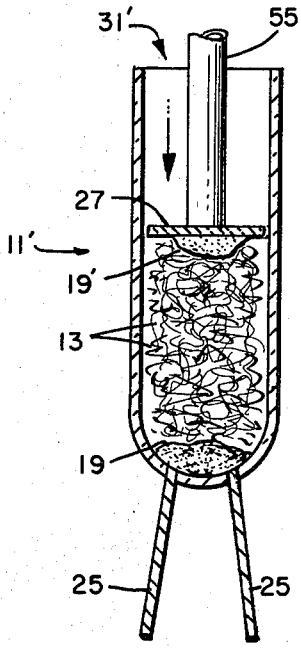
FIG. 6
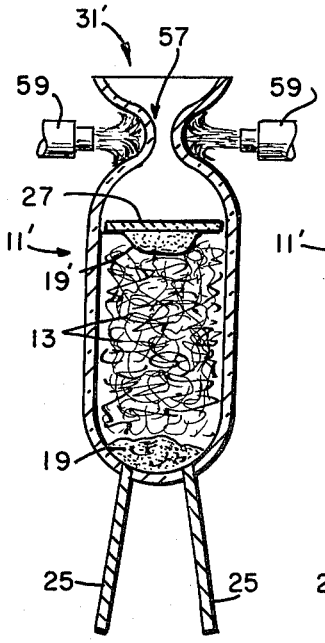
FIG. 7
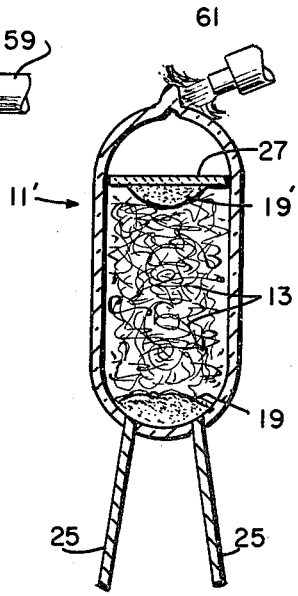
FIG. 8

METHOD OF MAKING PHOTOFLASH LAMP

TECHNICAL FIELD

The present invention relates to photoflash lamps and particularly to photoflash lamps which are electrically activated. Even more particularly, the invention relates to methods of making such lamps.

BACKGROUND

Lamps of the above type are generally classified into two varieties: low-voltage and high-voltage. Low-voltage photoflash lamps typically include a glass envelope with a combustion-supporting gas (e.g., oxygen) and a quantity of filamentary, combustible materials (e.g., shredded hafnium or zirconium) therein. A pair of electrically conductive lead wires are usually sealed in one end of the envelope and extend therein. A filament is utilized and interconnects the extending ends of the wires. When the filament is heated by a firing current usually generated from a low-voltage source such as battery or charged capacitor (e.g., having a voltage of from about 1.5 to 15 volts), it ignites a primer material which then ignites the combustible material to produce a flash of light. Naturally, the oxygen gas aids in the above ignition. In high-voltage lamps, the use of a filament is usually excluded by the provision of a glass or ceramic bead in which are located the extending ends of the lamp's conducting wires. The combustible-igniting primer material serves to bridge the portions of these ends which project through the bead. High-voltage lamps also include the aforedescribed filamentary material and combustion-supporting gas. Flashing is accomplished by a firing pulse approaching a few thousand volts and usually provided by a piezoelectric element. In another type of high-voltage lamp, the primer is located within an indentation in the bottom of the clamp and the conductive wires extend therein.

The teachings of the instant invention are particularly concerned with methods of making high voltage lamps, although it will be understood from the following that said teachings may be readily extended to lamps of the earlier generation, low voltage variety. Even more particularly, the teachings as provided herein are especially concerned with high voltage lamps wherein the primer material is to be located in the bottom of the lamp (e.g., along a bottom surface thereof).

Locating the lamp's primer material within a recess, cavity, indentation, etc. at the bottom end (that containing the lamp's two lead-in wires) of the envelope is particularly desirable in photoflash lamps of the subminiature variety (e.g., those having an internal volume of less than about 0.2 cubic centimeters) in view of the relatively large space required by the lead-in wires which form part of the lamp's ignition structure (the primer material typically forming the remaining part). While this arrangement allows for the saving of precious internal volume of the lamp's envelope to thereby enble relatively larger volumes of shredded combustible therein, uniform ignition of the combustible shreds can prove somewhat difficult in that the shred mass typically burns from one end of the envelope to the other when ignited. Accordingly, various factors such as extent of compaction and final shred mass location can adversely affect the combustion rate of this mass. This in turn can adversely alter (e.g., extend) the peak output time for the ignited lamp as well as the total light output. With particular regard to peak output time, it is understood that this parameter is critical in view of the requirement that the lamp's peak output must coincide with the shutter operation of the corresponding camera utilizing a photoflash lamp of this variety.

The present invention, as will be defined, describes a new and unique method of making a photoflash lamp such that the finished product includes a novel means of ignition for the lamp's shredded combustible material such that the combustion rate of this material is substantially increased. The finished product as produced by the invention also enables the shredded combustible material to burn in a substantially more uniform manner than typical photoflash lamps of the prior art. Although the teachings as provided herein are particularly adaptable to photoflash lamps of the electrically-activated, subminiature variety, it is understood that these teachings are also applicable to other varieties of high voltage photoflash lamps, including those containing the aforementioned ignition structure wherein a glass support bead or similar component is also used.

It is believed, therefore, that a method of making a photoflash lamp in the manner defined herein would constitute a significant advancement in the art.

DISCLOSURE OF THE INVENTION

It is primary object of the present invention to provide a new and unique method of making an electrically-activated photoflash lamp wherein the completed lamp possesses an ignition structure capable of igniting the lamp's combustible material at a substantially increased rate over typical photoflash lamps of the prior art and wherein the combustible material burns substantially more uniformly than said prior art lamps.

It is another object of the present invention to provide a method of making a photoflash lamp which can be readily achieved on a mass production basis and therefore at relatively low cost.

In accordance with one aspect of the invention, there is provided a method of making a photoflash lamp, said method comprising providing an elongated, light-transmitting tubular member having opposing open ends, sealing a first open end of said tubular member, said sealed first end including a pair of lead-in wires secured therein each having an end portion having access to the interior of said tubular member, positioning a first quantity of primer material within said tubular member through an opposing, second open end thereof, said first quantity of primer material electrically connected to said end portions of said lead-in wires, positioning a predetermined quantity of combustible, light-producing material within said tubular member through said opposing, second open end thereof, positioning a thin member within said tubular member through said opposing, second open end thereof, said thin member having located thereon a second quantity of primer material, said thin member being positioned within said tubular member such that said second quantity of primer material is positioned immediately adjacent said combustible material, and sealing said second end of said tubular member to define an envelope.

BRIEF DESCRIPTION OF THE DRAWINGS

FIGS. 3–8 represent the various steps of producing the lamp in FIG. 1 in accordance with a preferred embodiment of the invention.

BEST MODE FOR CARRYING OUT THE INVENTION

For a better understanding of the present invention, together with other and further objects, advantages, and capabilities thereof, reference is made to the following disclosure and appended claims in connection with the above-described drawings.

Figure 1:
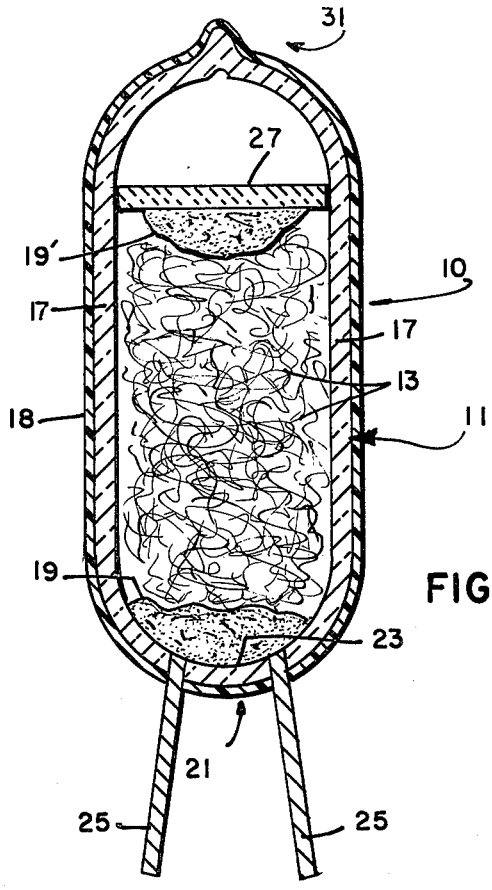
In FIG 1, there is shown an electrically-activated photoflash lamp produced in accordance with the teachings of the instant invention.

With particular attention to FIG. 1, there is shown a photoflash lamp 10 as produced in accordance with the teachings of the invention. Lamp 10 comprises an elongated, light-transmitting envelope 11, a quantity of combustible, light-producing material 13 positioned within the envelope, and an ignition means 15 for igniting the combustible 13. Envelope 11 is preferably of glass (e.g., lime glass), but may also be of a suitable plastic or similar insulative material. By the term light-transmitting is meant any material which permits passage of the high intensity light as typically provided from a photoflash lamp therethrough without substantially altering said output. Envelope 11, in cross-section, is preferably of substantially cylindrical configuration having an external diameter of about 0.210 inch. Each of the longitudinal side walls 17 of the envelope possess a thickness of about 0.020 inch. The total internal volume of envelope 11 is somewhat less than about 0.200 cubic centimeter, specifically, about 0.175 cubic centimeter. As stated, envelope 11 is of substantially elongated shape. In one specific example, the finished envelope (as shown in FIG. 1) possessed a total length of about 0.650 inch. This length understandably is about three times the envelope's external diameter.

Lamp 10 also includes a protective, light-transmitting coating 18 about envelope 11 to prevent escapement of particles of envelope material should the envelope be subjected to excessively high internal pressure during ignition thereof. Coating 18 is preferably cellulose acetate.

Combustible, light-producing material 13 is preferably zirconium of hafnium and more preferably of shredded configuration. That is, material 13 is comprised of several individual shreds of the stated metal wherein these shreds are sheared from a sheet of thin foil. Use of shredded combustible material of the variety described is well known in the art and further description is not believed necessary. In one example, a total of approximately 12 milligrams of zirconium shreds was utilized within the lamp vessel.

Ignition means 15 comprises a first quantity of primer material 19 located within a first, bottom end 21 of envelope 11. As shown, first primer material 19 is positioned along the bottom wall 23 of end 21. In one example, a total of from about 0.500 to about 0.750 milligrams of primer was used. First primer material 19 comprised a mixture of about 80 percent by weight zirconium and about 20 percent by weight potassium perchlorate. It is to be understood, however, that other materials such as are known in the art may be utilized. It is also possible to modify the percentages of those materials as defined without adversely affecting the performance of lamp 10. As shown in FIG. 1, ignition means 15 further includes a pair of lead-in wires 25 which are secured within the bottom end of envelope 11 in electrical contact with the first primer material 19. Sealing of each of the lead-in wires 25 is accomplished in the manner defined below and further description is therefore not believed necessary. Each wire 25 is preferably of a nickel-iron alloy and possesses an external diameter of about 0.015 inch. Wires 25 are spaced apart within the bottom end 21 of envelope 11 a total distance of about 0.040 inch. Application of a suitable pulse (such as a high voltage, low energy pulse as provided by a piezoelectric element typically utilized in many of today's pocket-type cameras) results in generation of a spark between the ends of each wire which are in contact with first primer material 19. Passage of this spark through the first primer material 19 results in ignition thereof to in turn ignite the portion of the shredded combustible material 13 located immediately adjacent primer material 19. As shown, the end portions of lead-in wires 25 which contact primer material 19 are flush with interior surface 23.

Figure 2:
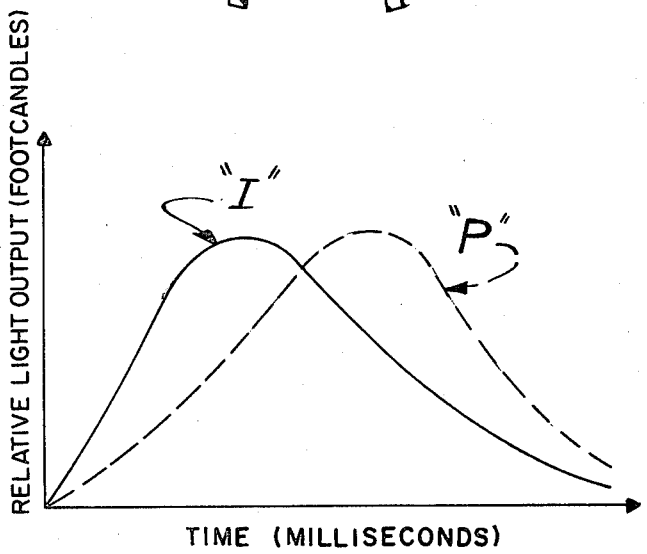
FIG. 2 represents a graph comparing the relative light output versus total output time between a photoflash lamp produced according to the instant invention, and a typical photoflash lamp of approximately the same size.

Ignition means 15 further comprises a second quantity of primer material 19' which is located on a thin member 27 which in turn is positioned at an opposing, second end of envelope 11 from the aforedefined bottom, sealed end 21. In one example, the second primer material 19' was of the same composition as that of first quantity 19. A similar amount (weight) was also utilized. As shown in FIG. 1, the second quantity of primer material is positioned immediately adjacent (and in physical contact with) the shredded combustible 13 but on an opposing end thereof from the first quantity 19. This material, when ignited by the first primer material 19, in turn serves to ignite the portion of shredded combustible located adjacent thereto. It can be seen, therefor, that first primer 19 almost simultaneously serves to ignite the lowermost portion of shredded combustible as well as the spaced, second quantity of primer material 19'. The second quantity in turn almost instantly serves to ignite the opposing, non-ignited portion of combustible material 13 such that this material burns from opposing ends thereof toward the center and therefor at an accelerated rate over ignition means typically found in the prior art. This results in earlier peak output (see FIG. 2) over a similar lamp not including a second quantity of primer material in the arrangement depicted in FIG. 1. The relative light output (in footcandles) in comparison to the output time (in milliseconds) for lamp 10 is represented by the curve "I". The corresponding relative light output of a similar electrically-activated photoflash lamp not possessing a second primer is represented by the dashed curve "P". In making these comparisons, similar quantities of shredded combustible and first primer material were utilized. In addition, each of the glass envelopes used possessed the same internal volume. It can be readily seen from the graph in FIG. 2 that the relative light output of the lamp produced in accordance with the instant invention advantageously peaks at a substantially earlier period from that of the control mode. In addition, photographic prints as produced from cameras utilizing lamp 10 typically possessed fewer, if any, "hot spots" than prints exposed using photoflash lamps such as the control mode described above, thus indicating that the resulting light output from lamp 10 is more uniformly distributed over the subject matter being illuminated during exposure of the print negatives.

The thin member 27 used in lamp 10 comprises a substantially cylindrical 0.002 inch thick mica disk having an external diameter of about 0.160 inch. Because this external diameter is about 0.010 inch less than the corresponding internal diameter for the cylindrical envelope 11, disk 27 is substantially loosely positioned atop combustible material 13 (see below). The disk is also prevented from upward displacement by the tipped end portion 31 of envelope 11. In producing lamp 10 (in the manner shown in FIGS. 3–8), it is understood that the tipped end 31 is achieved subsequent to insertion of disk 27 and the corresponding second primer 19' within the open second end of the glass tubing which eventually constitutes envelope 11 (see FIGS. 3–6 below). The first quantity of primer 19 and shredded combustible 13 are previously positioned within this open end, said positioning occuring after the aforementioned sealing of the two lead-in wires 25 within first end 21. Tipping of the glass tubing to provide end 31 (FIG. 8) can be accomplished using techniques known in the photoflash lamp art. One distinct advantage of the method taught herein is that utilization of disk 27 substantially eliminates the possibility of combustible shred material being captured within tip portion 31 during sealing thereof, a common occurrence when tip-sealing subminiature lamp envelopes. Shred material within the second end can adversely affect the seal formed thereat. Understandably, positioning of disk 27 prior to forming the second sealing operation forces substantially all of the shred material downwardly within envelope 11, thus preventing the above undesirable occurrence.

It is also possible to utilize a material other than mica for disk 27. For example, it is possible to use an aluminum disk with equal success, said disk possessing substantially the same configuration and dimensions described above. It is also possible to provide a disk of a different configuration than stated, with suitable examples being either square or rectangular. A cylindrical configuration is preferred when a corresponding cylindrical-shaped glass envelope is employed. It is even further possible to frictionally insert the primered disk 27 within envelope 11 to provide a more stationary means of positioning said component. This is not necessary, however, that the primer and disk members can be loosely positioned in the manner indicated.

In FIGS. 3–8, there are shown the various steps of producing photoflash lamp 10 in accordance with a preferred embodiment of the instant invention. In FIG. 3, an elongated, light-transmitting tubular member is provided and sealed at a first end 21' thereof. In its original form, the tubular member (11') is of cylindrical configuration and contains opposing open ends (the first open end being shown as now sealed in FIG. 3). It is understood that the elongated tubing member 11' is to eventually comprise the finished envelope (11) of lamp 10 and is therefore of the material described above (e.g., lime glass). The first open end of tubing member 11' is sealed to secure the lead-in wires 25 therein. The preferred method of sealing first end 21' is defined in copending application under Ser. No. 170,509, entitled "Electrically-activated Photoflash Lamp Excluding a Press-sealed End Portion and Method of Making Same" (Inventors: A. C. Bouchard et al). Ser. No. 170,509 was filed July 21, 1980, and is assigned to the same assignee as the instant invention. Specifically, heat is applied to the first open end of a glass tubing member while in the inverted state such that the glass will flow about and capture the end portions of the downwardly projecting lead-in wires 25 to provide securement thereof. It is understood with regard to the invention that other methods of sealing first end and secured lead-in wires 25 can be utilized, including the well known step of press-sealing.

In FIG. 4, the aforedefined first quantity of primer material 19 is inserted within tubing member 11' through the opposing, second open end 31' thereof. Primer 19 is originally disposed on a suitable transfer device such as a 0.0625 inch diameter steel rod 51. The primer is initially deposited on the bottom surface 23 of tubing member 11' in wet (liquid) form and the steel rod 51 removed. It is thus seen that because the extreme end portions of each lead-in wire 25 has access to the internal region of tubing member 11', the deposited first quantity of primer material 19 is able to physically contact said extreme ends and thus be in electrical connection therewith upon drying. The first quantity of primer material is dried by subjecting tubing member 11' to an elevated temperature of about 60 degrees Celsius for about 15 minutes.

With primer 19 dried, the aforementioned quantity of combustible material 13 is air blown within the open end 31'. A preferred technique for accomplishing positioning of the combustible within tubing member 11' is to use an air flow at a pressure of about three atmospheres, said technique described in U.S. Pat. No. 3,630,650 (P. Kaufmann et al). In FIG. 5, the member represented by the numeral 53 comprises the air nozzle utilized to direct air in the direction indicated.

In FIG. 6, thin member 27, having the described second quantity 19' of primer material thereon is inserted within the second, open end 31'. The preferred transfer device for inserting mica disk 27 is a vacuum tweezer, model EVG-100, available from the AIR-VAC Engineering Company, P.O. Box 522, Milford, CT., 06461. This mechanism, represented by the numeral 55, is readily adaptable to mass production equipment as is the steel transfer rod 51 (FIG. 4), thus rendering the instant invention ideally suited for mass production and the distinct cost advantages associated therewith. Upon release of the vacuum within tweezer 55, the cylindrical disk 27 rests atop the combustible 13 with the second quantity 19' of primer material physically contacting said combustible.

Prior to insertion of disk 27 within tubing member 11', the second quantity 19' of primer is deposited on the disk in liquid form and thereafter placed within an electric oven at approximately 60 degrees Celsius for about 15 minutes. One example of a suitable oven for use in the invention is model JW11TA Blue M Utility Oven, sold by the Blue M Engineering Company, Blue Highland, IL 60406. It is therefore understood that when disk 27 is inserted within tubing member 11', the second quantity 19' is dried thereon.

In FIG. 7, a restriction 57 is provided in the vicinity of open end 31' and immediately above the mica disk 27. A pair of opposed natural gas-oxygen or air burners 59 is utilized to provide this narrowed restrictive portion in tubing member 11'. It is thus seen that utilization of mica disk 27 prevents the possibility of combustible shred material being located within the narrowed, restrictive portion of tubing member 11' immediately prior to providing a seal at the second end thereof. Accordingly, an effective seal (tipped end) can be accomplished without the possibility of shreds being sealed within the glass at this end. It is also seen that use of disk 27 aids in compaction of combustible 13.

Tipping (or sealing) of the second open end of tubing member 11' is accomplished by a technique well known in the art (e.g., one using an oxygen flame burner 61) and further description is therefore not believed necessary. Immediately prior to tipping of tubing member 11' to define the final configuration for the lamp's envelope, it is preferred to introduce a combustion supporting atmosphere such as oxygen within the tubing member through the remaining open end thereof. In one example of the invention, the oxygen was established at a pressure of from about 6 to 8 atmospheres within the formed envelope. This technique is also known in the art and further description is not provided. After forming of the completed envelope, the envelope is covered with a protective, light-transmitting coating (18 in FIG. 1). A preferred material for coating 18 is cellulose acetate. This material is applied using a technique known in the art (e.g., by dipping the envelope within a container of liquid solution, or using vacuum-forming of the material in solid form).

While there have been shown and described what are at present considered the preferred embodiments of the invention, it will be obvious to those skilled in the art that various changes and modifications may be made therein without departing from the scope of the invention as defined by the appended claims.

We claim:

1. A method of making a photoflash lamp, said method comprising:

providing an elongated, light-transmitting tubular member having opposing open ends;

sealing a first open end of said tubular member, said sealed first end including a pair of lead-in wires secured therein each having an end portion having access to the interior of said tubular member;

positioning a first quantity of primer material within said tubular member through an opposing, second open end thereof, said first quantity of primer material electrically connected to said end portions of said lead-in wires;

positioning a predetermined quantity of combustible, light-producing material within said tubular member through said opposing, second open end thereof;

positioning a thin member within said tubular member through said opposing, second open end thereof, said thin member having located thereon a second quantity of primer material, said thin member being positioned within said tubular member such that said second quantity of primer material is positioned immediately adjacent said combustible material; and sealing said second end of said tubular member to define and envelope.

2. The method according to claim 1 further including positioning said first quanity of primer material on an internal surface of said first, sealed end portion of said tubular member in liquid form and thereafter drying said first quantity prior to said positioning of said combustible material.

3. The method according to claim 1 further including introducing a combustion-supporting gas within said tubular member through said opposing, second open end immediately prior to said sealing thereof.

4. The method according to claim 1 further including introducing a combustion-supporting gas within said tubular member through said opposing, second open end immediately prior to said sealing thereof.

5. The method according to claim 4 further including providing a restriction within said tubular member in the vicinity of said opposing, second open end prior to said introduction of said combustion-supporting gas.

6. The method according to claim 1 wherein said second quantity of primer material is positioned on said thin member in liquid form and thereafter dried prior to said positioning of said thin member with said tubular member.

7. The method according to claim 1 further including the step of providing a protective, light-transmitting coating on the external surface of said defined envelope.

* * * * *